US005640664A

United States Patent [19]

Ukei et al.

[11] Patent Number: 5,640,664

[45] Date of Patent: Jun. 17, 1997

[54] ENVELOPE FEEDING APPARATUS AND ELECTRONIC MACHINE HAVING ENVELOPE FEEDING APPARATUS

[75] Inventors: Syoji Ukei, Hitachi; Tomoji Kitagishi, Tokai-mura; Shigetaka Furukawa, Iwaki, all of Japan

[73] Assignee: Hitachi, Ltd., Tokyo, Japan

[21] Appl. No.: 542,469

[22] Filed: Oct. 12, 1995

[30] Foreign Application Priority Data

Oct. 17, 1994 [JP] Japan ..... 6-250363

[51] Int. Cl.[6] ..... G03G 15/00

[52] U.S. Cl. ..... 399/393; 271/2; 271/160

[58] Field of Search ..... 355/309; 347/139, 347/153; 271/2, 160, 162, 164, 167, 171

[56] References Cited

U.S. PATENT DOCUMENTS

| | | | |
|---|---|---|---|
| 4,828,245 | 5/1989 | Shimogawara | 271/160 X |
| 5,219,156 | 6/1993 | Mori | 271/160 X |
| 5,320,338 | 6/1994 | Shinohara et al. | 271/164 |

FOREIGN PATENT DOCUMENTS

| | | |
|---|---|---|
| 3127077A | 5/1991 | Japan . |
| 3-172881 | 7/1991 | Japan . |

*Primary Examiner*—Joan H. Pendegrass
*Assistant Examiner*—Sophia S. Chen
*Attorney, Agent, or Firm*—Kenyon & Kenyon

[57] ABSTRACT

In a recording medium feeding apparatus for use in an electronic photography printing machine, an outer appearance of a popular paper feeding apparatus is formed to have the same outer appearance of an envelope feeding apparatus, thereby by exchanging the two feeding apparatuses the object to be recorded can exchange from the popular papers to the envelopes. The envelope feeding apparatus is formed to have the same height toward the right side and the left side of the envelopes when the envelopes are mounted and to make equal the force added to the right side and the left side. An envelope pressing member of the envelope feeding apparatus is constituted of a rod shape elastic member. A spring member supports the envelope pressing member as a fulcrum at one end portion of the envelope pressing member and opens or closes by the pressurized force and another end of the envelope pressing member is consistent with a tip end of the envelopes. The right and left height of the envelope pressing member or a base member is made different and forms a step form construction.

9 Claims, 5 Drawing Sheets

ENVELOPE FEEDING APPARATUS AND ELECTRONIC MACHINE HAVING ENVELOPE FEEDING APPARATUS

BACKGROUND OF THE INVENTION

The present invention relates to an envelope feeding apparatus for use in an electronic machine having an envelope feeding apparatus such as an electronic copying machine and an electronic photography printing machine etc., and particularly to an envelope feeding apparatus suitable for feeding a stacked state plural sheet envelopes.

Up to now, in a feeding apparatus for envelopes in an electronic copying machine and an electronic photography printing machine etc., because of many various kinds of the envelopes and many different shapes of the envelopes even in the envelopes having same sizes, it is technically difficult to attain a method of continuously feeding the plural sheet envelopes and a method of printing the envelope having a high quality under the condition of having stacked envelopes.

In particular, in a western style envelope such as an envelope (US#10, 24 lb), a flap portion of the envelope is provided to form in parallel toward a longitudinal direction of the envelopes or toward a feeding direction of the envelopes. The above western style envelope is fed to feed toward the longitudinal direction of the envelopes.

In the above case, height of the envelope at a side of the flap portion of the envelope differs from height of the envelope at a side of an anti-flap portion of the envelope. The anti-flap portion of the envelope in the present specification indicates a lower side portion of the rectangular part of the envelope. The flap portion of the envelope is continuously and integrally provided on an upper side of this rectangular part of the envelope.

Therefore, it is difficult to transfer the envelopes and further a skew state (a squint form feeding state of the envelopes) and a failure in the envelope feeding operation easily occur. As a result, so as to feed the plural sheet envelopes, in general a method for feeding the envelopes is provided where each sheet is inserted by hand of an operator through a manual envelope feeding insertion unit which is provided on a main body of the electronic copying machine.

In the electronic copying machine, since the operator himself operates the machine, it is possible to carry out the insertion for the envelope by his hand through the manual envelope feeding insertion unit.

Besides, in the electronic photography printing machine, the construction has a function in which the printing of the envelopes and/or the papers is carried out under a non-scheduled condition through a command from plural word processors or plural personal computers etc. By the above stated reasons, an envelope feeding apparatus able to feed plural sheet envelopes is indispensable to the electronic photography printing machine.

Recently envelope feeding apparatus for exclusively feeding envelopes is found here and there, however there occurs large technical problems for the envelope feeding operation because of the various shapes of the envelopes etc.

However, there are many problems to be solved for feeding the stacked envelopes, such as a low reliability of the envelope feeding operation, a skew state of a printing image due to the skew state envelope feeding operation and a folding state of a corner portion of the envelope according to deformation of the envelope etc.

So as to solve these above stated problems, a method of pressing under pressure an upper face of the stacked envelopes is frequently employed according to a member for pressing the envelope and a guide for passing through the paper (envelope). However, since the upper face of the envelope is pressed under pressure by the envelope pressing member, a resistance for feeding the envelope increases and then a force for feeding the envelope becomes insufficient.

Further, there is a case in which the envelope is pressed under pressure by the envelope pressing member having a high rigidity. In this case, when the envelope generates the moisture absorbent and the swelling, the height of the stacked envelopes differs between the side of the flap portion and the side of the anti-flap portion of the envelope.

Thereby, during the envelope feeding operation, an unbalance in the force for feeding the envelopes occurs between a left side (for example, the side of the anti-flap portion) of the envelope and a right side (for example, the side of the flap portion) of the envelope when the envelope is fed to the longitudinal direction of the envelope. As a result, there occur problems in which the skew state in the envelopes generates and the envelope feeding operation becomes impossible.

Further, in general the feeding operation of the envelopes is carried out by pressing through a paper (envelope) feeding roller under a pressing force from a lower face of the envelope.

With the above stated envelope feeding method, so as to lessen at the utmost the unbalance in the right side (for example, the flap portion side) pressing force and the left side (for example, the anti-flap portion side) pressing force, a longitudinal width of the paper (envelope) feeding roller is formed to be narrow as far as possible.

At this time, the stacked envelopes are pressed under pressure by the paper (envelope) feeding roller with the pressing force from the lower face of the envelope, then the deformation of the envelopes generates at an upper side of a tip portion of the right side of the envelope and also at an upper side of a tip portion of the left side of the envelope.

Besides, there is another type envelope feeding apparatus in which a method for feeding the envelopes is employed by stacking toward the longitudinal direction (the feeding direction) of a western style envelope. In this western style envelope, the flap portion of the envelope becomes parallel to the longitudinal direction of the envelopes.

In the above stated envelope feeding apparatus, stacked height of the envelopes differs between the side of the flap portion and the side of the anti-flap portion of the envelope and further the unbalanced condition between the right side of the envelope and the left side of the envelope occurs with respect to the paper (envelope) feeding roller, the member for pressing the envelope, and the guide for passing through the envelopes and the papers etc.

Further, when the envelope generates the moisture absorbent, it promotes the unbalance in the envelope stacked height between the side of the flap portion of the envelope and the side of the anti-flap portion of the envelope.

Consequently, the failure in the feeding operation of the envelope, the squint form feeding in the envelope, and the folding at the corner portion of the envelope at the guide portion for passing through the paper (the envelope) occur on the envelope feeding processing of the envelope feeding apparatus.

A picture image printing machine having a paper feeding apparatus as one printed document of the prior technique is disclosed, for example in Japanese patent laid-open publication No. 127077/1991.

SUMMARY OF THE INVENTION

An object of the present invention is to provide an envelope apparatus and an electronic machine having an envelope feeding apparatus wherein an unbalance in stacked height of plural sheet envelopes between a flap portion and an anti-flap portion of the envelopes can be dissolved.

So as to solve the above stated problems, it is necessary to make equal the stacked height of the stacked envelopes and to add an uniform pressure force of a right side (for example, a side of an anti-flap portion) of the envelopes and a left side (for example, a side of a flap portion) of the envelopes.

So as to make equal the stacking height of the stacked envelopes and to add uniformly the pressure forces of the right side and the left side of the envelopes, a member for pressing the envelopes is constituted by employing a rod shape elastic member and further a construction for enabling to open and close and to pressurize under a back tip portion of the rod shape elastic envelope pressing member as a fulcrum is employed.

Further, taking into consideration the difference in the height between the flap portion and the anti-flap portion of the envelopes, the construction in which the height at the right side and the height at the left side of the envelope pressing member is employed to constitute with a step form structure.

With respect to the swelling and the twist etc. in the envelope feeding processing, according to the difference in the height between the flap portion and the anti-flap portion of the envelopes and the moisture absorbent in the envelopes, a following construction is employed according to the present invention.

Namely, since the envelope pressing member is constituted according to the rod shape elastic member, the envelope feeding apparatus has a sufficient correspondence against the fluctuations, such as the various kinds or the various shapes of the envelopes.

So as to correct the deformation at the side of the flap portion of the envelope, it is valid to perform a contacting portion between the envelopes pressing member and the anti-flap portion of the envelopes at a tip portion of the flap portion of the envelope, thereby the transfer for the envelopes to the guide for pressing through the paper (envelope) can be smoothly carried out.

Further, so as to lessen the skew state of the envelope at the utmost, it is important to equally pressurize the envelopes pressing member from the right side of the envelopes and from the left side of the envelopes with respect to a whole envelope.

For the purpose of the above, by anticipating the differences deformation between the flap portion and the anti-flap portion of the envelopes, it can be solved by making the envelope pressing member with a step form construction taking into the consideration under the difference between the right side and the left side of the envelopes.

Namely, it can correspond to make lower the side of the envelope pressing member, on which the anti-flap portion of the envelope is held, than the side the envelope pressing member, on which the flap portion of the envelope is held, for example.

When the flap portion of the envelopes is loaded upside down, since the pressurizing force of the envelope becomes unbalance, it can correspond to employ a construction in which the envelope pressing member supported by a supporting plate is detachably and reversibly inserted from the right side of the electronic printing machine and from the left side of the electronic printing machine.

BRIEF DESCRIPTION OF THE DRAWINGS

in FIG. 12.

DETAILED DESCRIPTION

Hereinafter, one embodiment of a color electronic photography printing machine having an envelope feeding apparatus according to the present invention will be explained referring to drawings.

Figure 1:
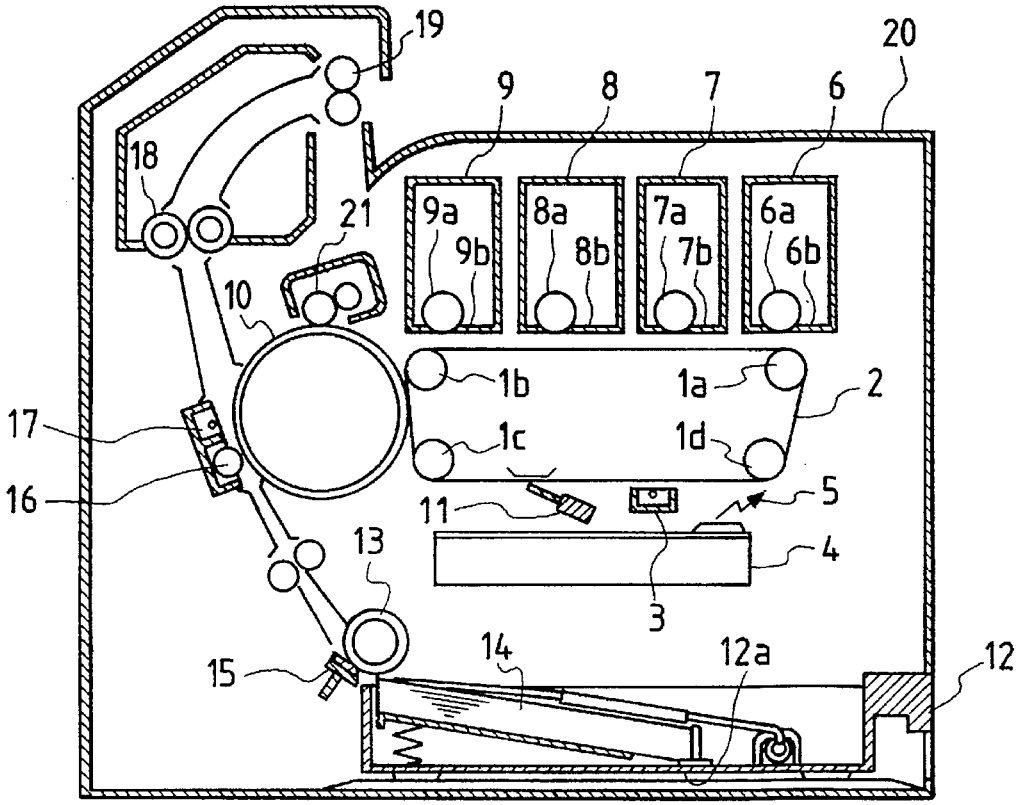
FIG. 1 is a longitudinal cross-sectional side view showing one embodiment of a color electronic photography printing machine having an envelope feeding apparatus according to the present invention.

FIG. 1 is a whole constructive view of a color electronic photography printing machine having one embodiment of an envelope feeding apparatus according to the present invention.

Around belt guide rollers 1*a*, 1*b*, 1*c* and 1*d* including a roller used for driving, a photosensitive belt 2 is hung and is rotated. The photosensitive belt 2 is uniformly charged by a charging means 3 and the photosensitive belt 2 is exposed by a laser beam 5 which is irradiated from an optical system box 4 and then an electrostatic image is formed.

Through developing means 6, 7, 8 and 9, the electrostatic image formed on the photosensitive belt 2 is developed color by color by the toners within the developing means 6, 7, 8 and 9 and the developed electrostatic image is transferred to an intermediate transfer drum 10.

The toner image having the respective color is overlapped on the intermediate transfer drum 10 and then a color image is formed. Residual toners on the photosensitive belt 2 are removed every time by a belt cleaner 11.

For example, the developing means 6 of a first stage is formed as a yellow color developing means 6 using two component developing agent which are mixed by yellow toners and ferrite carriers. In this case, the electrostatic image formed on the photosensitive belt 2 according to the yellow color image information passes at a lower side of the yellow color developing means 6.

With the above stated two component developing agent, by exposing a magnet brush formed according to a developing magnet roller 6*a* from an opening portion 6*b* and by slidingly brushing on the photosensitive belt 2, the electrostatic image is developed to the yellow toner image.

This developed yellow color toner image is transferred to the intermediate transfer drum 10. After the transfer of the developed yellow color toner image, the residual toners on the photosensitive belt 2 are removed by the belt cleaner 11 and after that the yellow color toner image is uniformly charged again by the charging means 3 and according to the laser beam 5 a magenta color electrostatic image is formed.

This magenta color electrostatic image is developed by the magnet brush formed on an opening portion 7*b* of a developing magnet roller 7*a* of the magenta color developing means 7, and after that the developed magenta color electrostatic image is transferred to the intermediate transfer drum 10.

Similar processing are performed with a cyan color developing means 8 and a black color developing means 9, then a color image is formed on the intermediate transfer drum 10.

In this figure, 8*a* denotes a developing magnet roller for use in the cyan color and 9*a* denotes a developing magnet roller for use in the black color, respectively. 8*b* denotes an opening portion of the cyan color developing magnet roller 8*a* and 9*b* denotes an opening portion of the black color developing magnet roller 9*a*, respectively.

After the color toner image has formed on the intermediate transfer drum 10 and an envelope 14 is extracted through an envelope feeding apparatus 12 having an envelope cassette 12*a* through a paper (envelope) feeding roller 13.

The above envelope feeding apparatus 12 has the same appearance of a paper feeding apparatus having a paper cassette for used in a popular A4 size paper. Each envelope feeding apparatus 12 having an envelope cassette 12*a* and a paper feeding apparatus having the paper cassette is detachably and exchangeably provided on a main body of the color photography copying machine.

The extracted envelope 14 is sent to a transfer portion of the intermediate transfer drum 10. By giving a transfer electric field by a transfer roller 16 the envelope 14 is pressed under pressure against the intermediate transfer drum 10 and then the color toner image is transferred to the envelope 14.

Besides, the envelope 14 of this embodiment has a size of 235 mm (vertical) and 105 mm (lateral), however the dimensions of the envelope 14 does not limit to the envelopes 14 having the above stated size.

When the envelope 14 is extracted from the paper (envelope) feeding roller 13, so as to not extract plural sheets of the envelopes 14, the envelope 14 is separated through a separation pad 15. When the envelope 14 on which the color toner image is transferred is separated from the intermediate transfer drum 10, AC (alternating current) charge removing means 17 removes charges from the envelope 14.

The envelope 14 is sent into a fixing means 18 and when the envelope 14 passes through the fixing means 18, the fixing means 18 heats and then the color toner image is fixed to the envelope 14.

The envelope 14 is discharged from a paper (envelope) discharging means 19 to a paper (envelope) discharging tray 20. A drum cleaner 21 removes the remaining toners on the surface of the intermediate transfer drum 10 which has finished the transfer of the color toner image.

By the way, in the general envelope feeding apparatus, it employs a method for pressing under pressure an upper face of the stacked envelopes. However, since the upper face of the envelope is pressed under pressure through an envelope pressing member, the resistance for feeding the envelopes increase, the force for feeding the envelopes becomes insufficient.

Further, when the envelope is pressed under pressure by the envelope pressing member having high rigidity, the envelopes generate moisture absorbent and swelling, then the stacking height differs between the side of the flap portion and the side of the anti-flap portion of the envelopes.

During the envelope feeding the unbalance of the envelope feeding force between the right side (for example, the anti-flap portion) and the left side (for example, the flap portion) of the envelope occurs, as a result there are problems in which the skew state in the envelopes may generate and also the inability for feeding the envelopes may invite, etc.

Further, so as to smoothly feed the envelope, in general a following method for feeding the envelopes is employed. Namely, in this method the envelopes are fed according to a pushing-up force from the lower face of the envelopes and by pushing the envelopes to the paper (envelope) feeding roller.

According to the above stated method, so as to lessen the unbalance between the right side and the left side of the envelope at the utmost, the longitudinal dimension (width) of the paper (envelope) feeding roller is formed to be narrow as far possible.

As a result, the stacked envelopes are pressed by the paper (envelope) feeding roller according to the pressing force from the lower face of the envelopes, thereby the right tip and the left tip portions of the envelopes occur the deformation directing toward the upper side.

The deformation of the tip portion of the envelopes differs at the right side and at the left side results from the western style envelope in which the flap portion of this envelopes becomes in parallel to the longitudinal direction (the envelope feeding direction) and further different height of the flap portion of the envelope is about five times of the different height of the anti-flap portion of the envelopes.

In a case that the thirty sheet envelopes (total thickness of about 20–25 mm) are stacked, the different height of the flap portion of the envelope is about 8–12 mm and the different height of the anti-flap portion of the envelope is about 1–2 mm, when the upper face of a central portion of a rectangular part of the envelope is standard against the above two different heights.

Further, when the envelopes generate the moisture absorbent (the relative humidity 80% RH, 25° C.), the different height of the flap portion of the envelope is about 13–18 mm and the different height of the anti-flap portion of the envelope is about 2–4 mm, when the upper face of the central portion of the rectangular part of the envelope is standard against the above two different heights.

The deformation in the tip portion of the envelopes is generated by such as envelope wrinkles, the skew state of the envelope, the folding in the corner portion of the envelope, during the envelope feeding operation and during biting operation of the envelope through the paper (envelope) feeding roller.

Further, in the method for pressing under pressure the envelope from the upper face of the envelopes, by the different deformation amount between the flap portion and the anti-flap portion of the envelopes, since the uniform pressing force is not added against to the envelopes, there are problems that the skew state in the envelopes and the failure in the envelope feeding operation occur.

Figure 2:
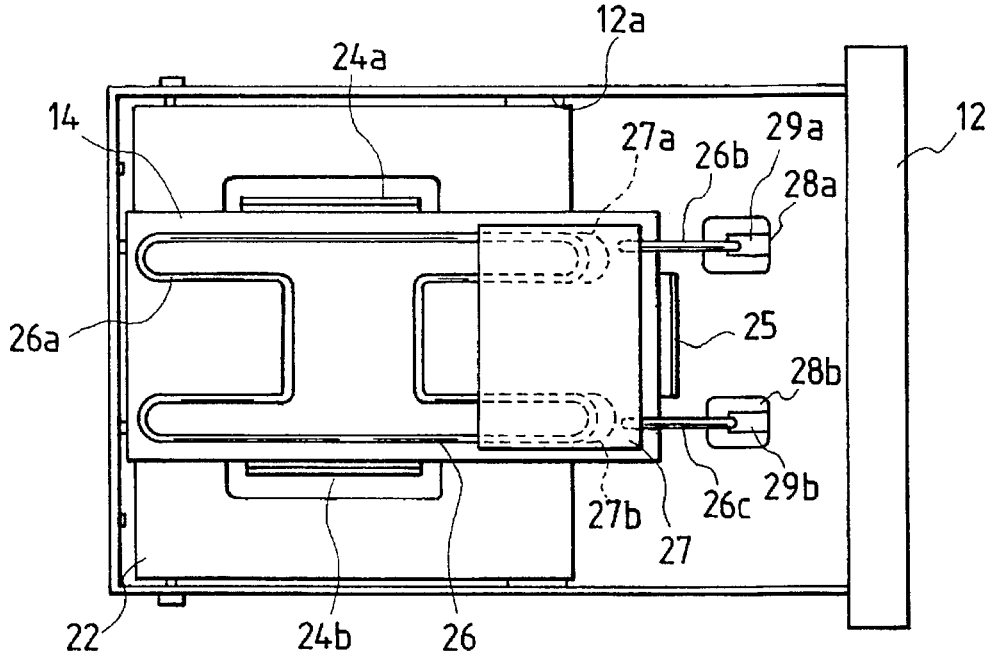
FIG. 2 is an enlarged view showing the envelope feeding apparatus having an envelope cassette according to the present invention which is provided on the color electronic photography printing machine shown in FIG. 1.
Figure 3:
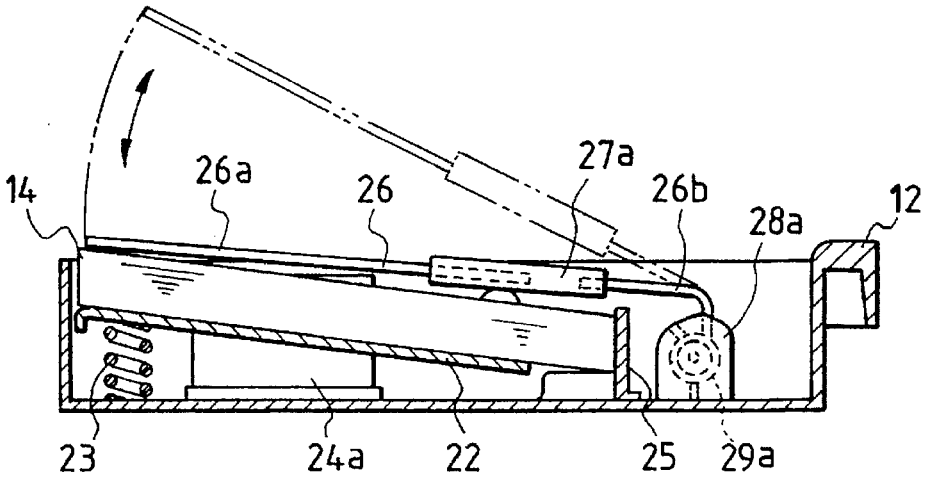
FIG. 3 is a longitudinal cross-sectional side view showing the envelope feeding apparatus having the envelope cassette shown in FIG. 2.

Now, so as to solve the above stated problems, the present invention is to provide the above envelope feeding apparatus 12 shown in FIG. 2 or FIG. 3 in detail.

FIG. 2 is a view showing the envelope feeding apparatus 12 according to the present invention viewed from an upper side, and FIG. 3 is a horizontal cross-sectional view showing the envelope feeding apparatus 12 according to the present invention.

The envelope feeding apparatus 12 comprises the envelope cassette 12*a*, a base member 22 for stacking the envelopes 14, a spring member 23 for pressurizing the base member 22 and the envelopes 14 to the paper (envelope) feeding roller 13 shown in FIG. 1, two side plates 24*a* and 24*b* for regulating the envelope 14 from the side face of the envelopes 14, and a back end side plate 25 for regulating the envelopes 14 from the back end side face of the envelopes 14.

The envelope feeding apparatus 12 comprises further an envelope pressing member 26 for pressing under pressure the envelopes 14 from the upper face of the envelopes 14. The envelope pressing member 26 is made of elastic material and has a continuous rod shape.

The envelope feeding apparatus 12 comprises further a supporting plate 27 for holding the envelope pressing member 26, fulcrum forming portions 28*a* and 28*b* for supporting the envelope pressing member 26 and the supporting plate 27, and two door spring members 29*a* and 29*b* holden in each of interior portions of the fulcrum forming portions 28*a* and 28*b* and for giving the pressure against the envelope pressing member 26.

The envelope pressing member 26 according to the present invention comprises an H-like form (taken from the longitudinal or an inserting direction of the envelope cassette 12*a*) and continuous rod shape front side envelope pressing part 26*a* and two straight form and continuous rod shape back side envelope pressing parts 26*b* and 26*c*.

Figure 4:
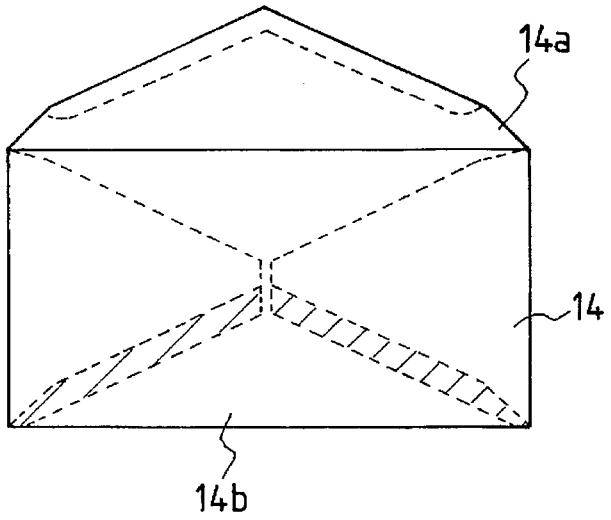
FIG. 4 is a plan view showing a front surface of the western style envelope.
Figure 5:
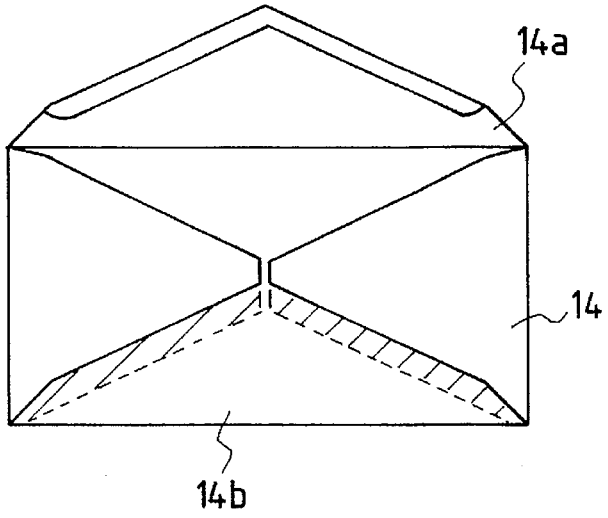
FIG. 5 is a plan view showing a rear surface of a western style envelope.

The front side envelope pressing part 26*a* of the envelope pressing member 26 has two front side reverse U-like parts. Each of the flap portion 14*a* and the anti-flap portion 14*b* of the envelope 14 as shown in FIG. 4 and FIG. 5 is pressed under pressure through each of the front side reverse U-like parts of the envelope pressing member 26, respectively.

Figure 10:
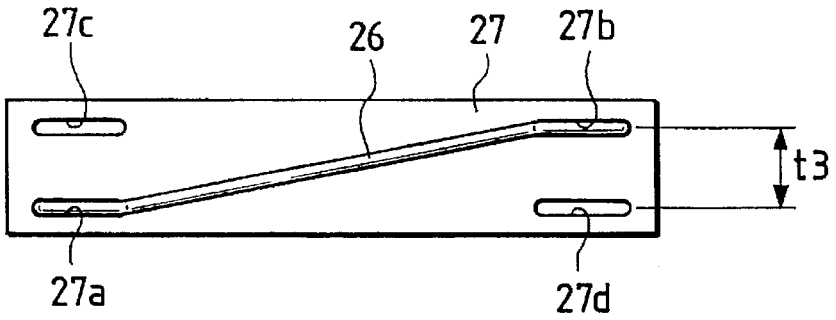
FIG. 10 is a view taken from Q direction side of the partial enlarged view shown in FIG. 9.
Figure 11:
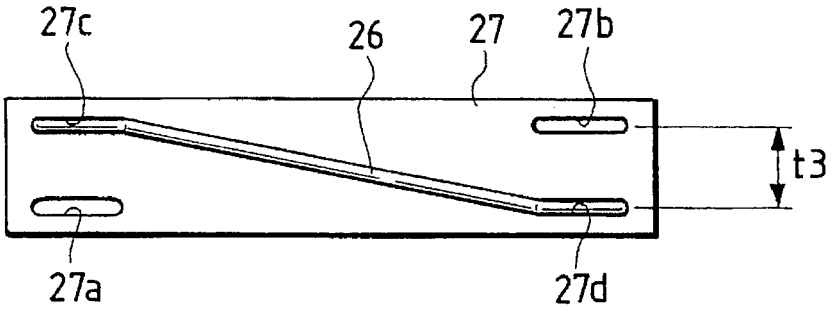
FIG. 11 is a view showing an installation relationship between an envelope pressing member and a supporting plate for supporting the envelope pressing member of another embodiment of an envelope feeding apparatus according to the present invention.

The front side envelope pressing part 26*a* of the envelope pressing member 26 has also two back side U-like parts. The two back side U-like parts of the envelope pressing member 26 are detachably inserted into grooves 27*a* and 27*b* formed in the supporting plate 27. The two grooves 27*a* and 27*b* of the supporting plate 27 are constituted with a step form structure as shown in FIG. 10 and FIG. 11.

The front side envelope pressing part 26*a* and the back side envelope pressing parts 26*b* and 26*c* of the envelope pressing member 26 are detachably mounted on the supporting plate 27. Namely, an intermediated portion of the envelope pressing member 26 is held by the supporting plate 27.

The door spring member 29 comprises a coil spring part and two straight projecting parts. This door spring member 29 works to forcibly urge the envelope spring member 26 toward the upper side of the envelope pressing member 26.

The envelope pressing member 26 is able to open and close according to the door spring member 29 holden in the interior portions of the fulcrum forming portions 28*a* and 28*b*, as shown an arrow mark in FIG. 3. After the envelopes 14 have accommodated on the envelope cassette 12*a*, then this envelope pressing member 26 pressurizes the envelopes 14. The force for pressurizing the envelope 14 is about 200–250 g in general.

Further, the envelope pressing member 26 is slidable and move the grooves 27*a* and 27*b* of the supporting plate 27, thereby it is possible to adjust the projected length of the envelope pressing member 26 against the supporting plate 27. With the above construction, it is possible to adapt to changes in the size of the envelope.

The shape of the envelope pressing member 26 is not limited to the shape shown in figures but in a case of using the envelope pressing member having the rod shape elastic material the effects can obtain similarly to the above stated effects according to the present invention.

FIG. 4 is a view showing the envelope 14 viewed from the front surface and shows a state in which the envelope 14 is opened. FIG. 5 is a view showing the envelope 14 viewed from the back surface and a squint line portion shows a turn-up adhesion portion. As shown in FIG. 4 and FIG. 5, the envelope 14 has the flap portion 14*a* and the anti-flap portion 14*b* on the rectangular portion of the envelope 14.

Figure 6:
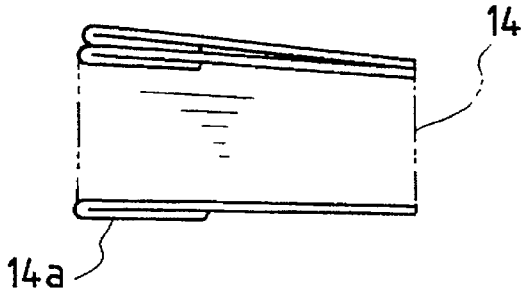
FIG. 6 is a side view showing a stacked state of the western style envelopes so as to explain the present invention.

When the plural sheet envelopes 14 shown in FIG. 4 and FIG. 5 are stacked toward the same direction, in the envelopes 14 it seems to provide a slope portion at one side. FIG. 6 shows the stacked state of the envelopes 14 when the flap portion 14*a* of the envelope 14 is put at the left side and the anti-flap portion 14*b* of the envelopes 14 is put at the right side.

Figure 7:
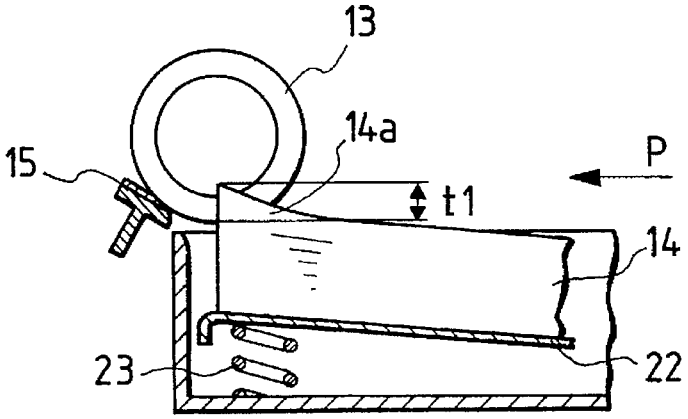
FIG. 7 is a partial enlarged view showing the stacked state of the western style envelopes in which a member for pressing the envelopes is removed so as to explain the present invention.

FIG. 7 is a pressurized state of the envelopes 14 against the paper (envelope) feeding roller 13 when the stacked envelopes 14 have accommodated in the envelope cassette 12*a* of the envelope feeding apparatus 12 without the envelope pressing member 26.

Figure 8:
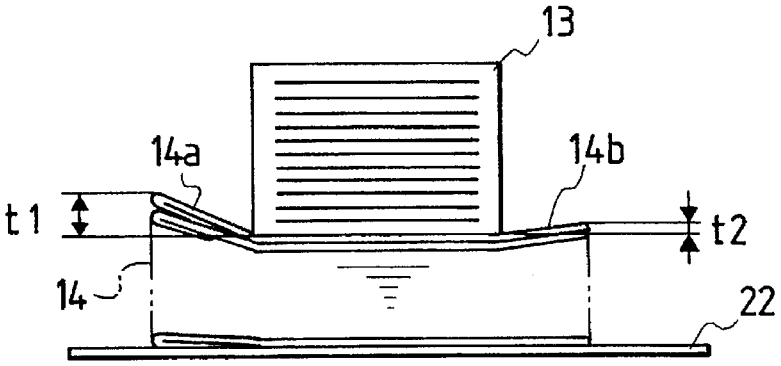
FIG. 8 is a view taken from P direction side of the partial enlarged view shown in FIG. 7.

Namely, the envelopes 14 shown in FIG. 4 and FIG. 5 are set on the envelope cassette 12*a* using the plural sheet envelopes 14 with shorter side at the top. FIG. 8 is a view showing a state of a case on which the envelope pressing member 26 is not provided on the envelope feeding apparatus 12.

According to the direction for setting the flap portion 14*a* of the envelopes 14 and according to the pressing pressure value of the paper (envelope) feeding roller 13, as shown in FIG. 8, there seems to be a phenomenon in which the right side height (the flap portion 14*a* height measured from the upper face of the stacked envelopes 14) of the envelopes 14 differs from the left side height (the anti-flap portion 14*b* height measured from the upper face of the stacked envelopes 14) of the envelopes 14.

Namely, since the longitudinal width of the paper (envelope) feeding roller 13 is less than half (≦½) of the lateral width of the envelope 14, the envelopes 14 are deformed by the pressure of the pressurizing spring member 23 as shown in the height t1 at the flap portion 14*a* side of the envelope 14 and the height t2 at the anti-flap portion 14*b* side of the envelope 14.

Herein, when the pressure of the pressurizing spring member 23 is about 500–550 g and the thirty (30) sheet envelopes (US#10, 24 lb) 14 are stacked on the base member 22, the height t1 at the flap portion 14*a* side of the envelopes 14 is about 8–12 mm and also the height t2 at the anti-flap portion 14*b* side of the envelopes 14 is about 1–2 mm.

When the envelopes 14 carry out the moisture absorbent (the relative humidity 80%, 25° C.), the height t1 at the flap portion 14*a* side of the envelopes 14 is about 13–18 mm and the height t2 at the anti-flap portion 14*b* side of the envelopes 14 is about 2-4 mm. In this case, the force for equalling the height t1 at the flap portion 14*a* side of the envelopes 14 and the height t2 at the anti-flap portion 14*b* side of the envelopes 14 is about 150–200 g.

Figure 9:
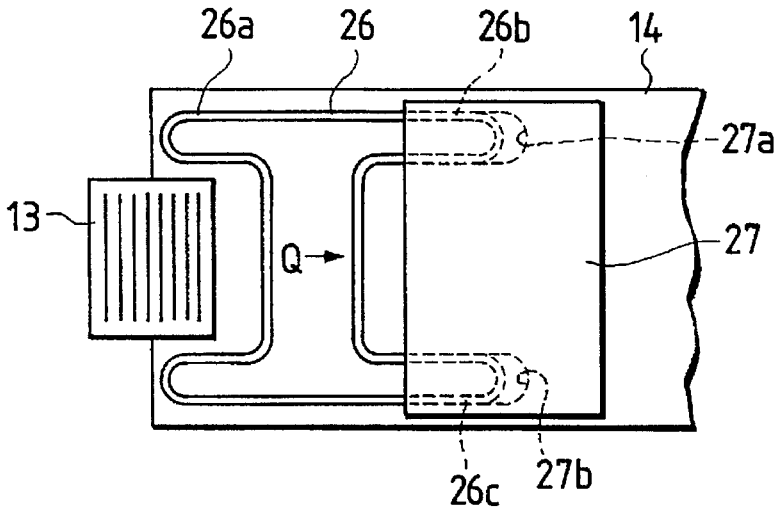
FIG. 9 is a partial enlarged view showing a positional relationship between the envelope pressing member, a supporting plate for supporting the envelope pressing member and a paper (envelope) feeding roller with the envelope in the envelope cassette of the envelope feeding apparatus according to the present invention.

FIG. 9 is a view showing the shape of the envelope pressing member 26, a pressuring state position for the envelopes 14 and a positional relationship between the envelopes 14, the envelope pressing member 26, the supporting plate 27 and the paper (envelope) feeding roller 13.

FIG. 10 is a view showing the installation relationship between the envelope pressing member 26 and the supporting plate 27. Each of the back side parts of the front side envelope pressing part 26*a* of the envelope pressing member 26 is detachably inserted into the grooves 27*a* and 27*b* of the supporting plate 27, respectively. Namely, the envelope pressing member 26 is detachably and diagonally installed to the step form structure comprised of the above stated two grooves 27*a* and 27*b*.

The insertion and detachment of the envelope pressing member 26 against the supporting plate 27 will be explained as followings. By reversely positioning the flap portion 14*a* of the envelope 14 when the envelopes 14 have accommodated on the base member 22 of the envelope cassette 12*a*, the similar function can be attained.

FIG. 11 is a view showing the installation relationship between the envelope pressing member 26 and the supporting plate 27 of another embodiment according to the present invention.

Namely, as shown in FIG. 11, in a case that the flap portion 14*a* of the envelopes 14 is reversely positioned in the envelope cassette 12*a* of the envelope feeding apparatus 12 or the flap portion 14*a* of the envelopes 14 is positioned at the left side in the envelope cassette 12*a*, the envelopes 14 are reversely accommodated by comparing with the above stated former embodiment of the present invention.

The front side envelope pressing part 26*a* of the envelope pressing member 26 is pulled out from the grooves 27*a* and 27*b* of the inserted state of the above stated embodiment. After that the front side envelope pressing part 26*a* of the envelope pressing member 26 is turn upside down and diagonally inserted into other two grooves 27*c* and 27*d*. The two grooves 27*c* and 27*d* are provided on the supporting plate 27 with a step form structure comprised of the above stated two grooves 27*c* and 27*d* as shown in FIG. 11.

Herein, so as to make equal the pressurizing forces at the right side and at the left side of the envelope pressing member 26, it is necessary to provide a step amount t3 in the height direction to the anti-flap portion 14*b* of the envelopes 14 which corresponds to the envelope deformation amount in the flap portion 14*a* having about 13–18 mm.

In a case in which the installing direction of the flap portion 14*a* of the envelopes 14 is limited, even the envelope pressing member 26 may be fixed to the supporting plate 27, even in this case the similar effects of the above stated former embodiment according to the present invention can be obtained.

Further, when the length of the envelope pressing member 26 is less than 150 mm, even the supporting plate 27 is not needed to provide in the envelope feeding apparatus 12, even this case the similar effects of the above stated embodiment according to the present invention can be obtained.

In the above stated explanation, the effects of the present invention can be obtained by varying the right side height or the left side height of the envelope pressing member 14.

However, by forming a central portion of the right and left side of the paper (envelope) feeding direction of the base member 22 to have a protrude shape and by forming a peripheral portion of the central portion to have at least one dent shape, further by adding the right and the left pressing forces to the envelope pressing member 26, the lift-up generated at the right side and the left side of the envelope can be restrained.

Further, it is preferable to set the dimension of the right and the left direction in the protrude portion wider than to some extent the width direction of the paper (envelope) feeding roller 13. Further, when the pressing force of the envelope pressing member 26 makes the difference in response to the lift-up amount shown in FIG. 8, even in this case the similar effects of the above stated former embodiment according to the present invention can be obtained.

Figure 12:
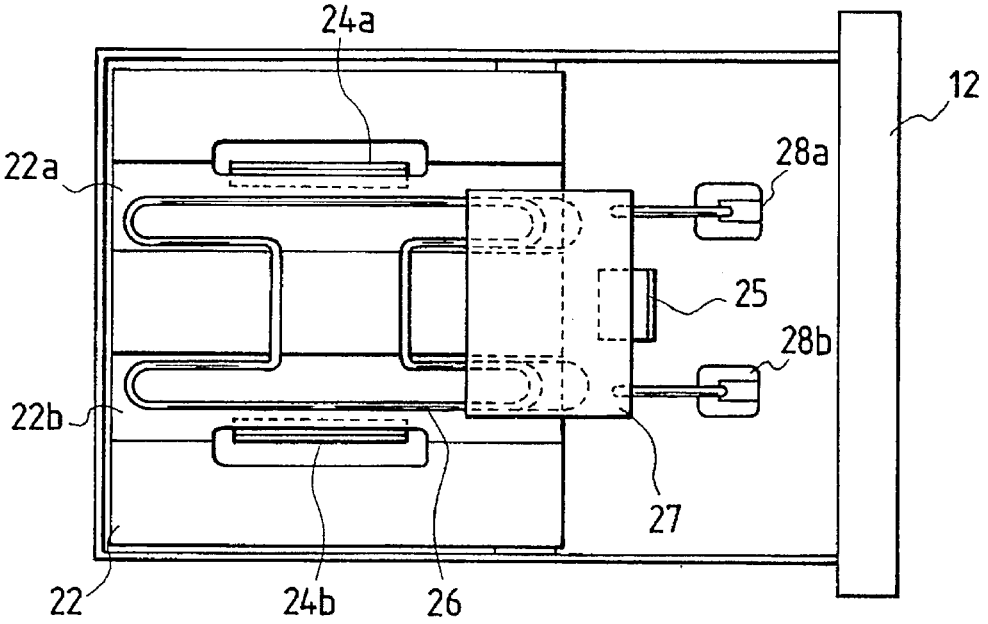
FIG. 12 is a view showing a positional relationship between an envelope pressing member, a supporting plate for supporting the envelope pressing member and a base member etc. of a further embodiment of an envelope feeding apparatus according to the present invention.

FIG. 12 is a further embodiment of the envelope feeding apparatus according to the present invention.

In FIG. 12, the base member 22 is pressurized by two spring members 23*a* and 23*b*. The base member 22 has two dent parts 22*a* and 22*b*. Each of the two dent parts 22*a* and 22*b* of the base member 22 is formed to have a substantial flat form base part at the feeding direction of the envelopes 14. The depth of the dent part 22*a* of the base member 22 is larger than the depth of the dent part 22*b* of the base member 22.

The side of the flap portion 14*a* of the envelopes 14 is arranged at the deeper depth portion 22*a* of the base member 22 and the side of the anti-flap portion 14*b* of the envelopes 14 is arranged at the shallower depth portion 22*b* of the base member 22.

Figure 13:
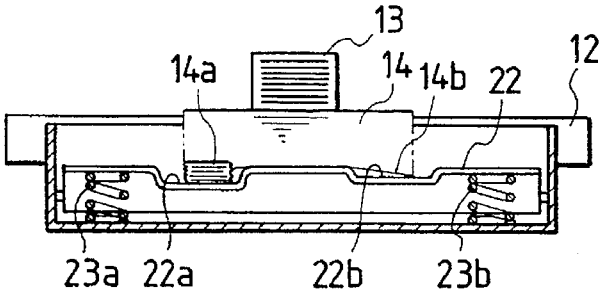
FIG. 13 is a partial cross-sectional view of showing the envelopes, the base member and the paper (envelope) feeding roller etc.
Figure 14:
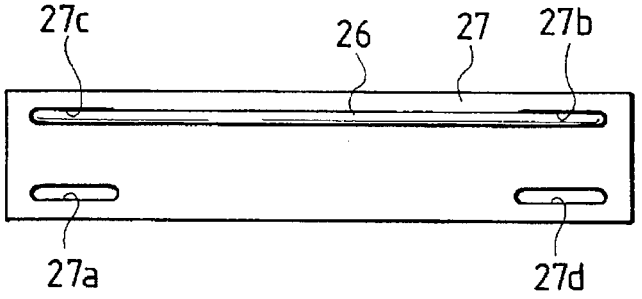
FIG. 14 is a view showing an installation relationship between the envelope pressing member and the supporting plate for supporting the envelope pressing member of the further embodiment of an envelope feeding apparatus according to the present invention.

In this embodiment of the present invention shown in FIG. 12 and FIG. 13, each of the back side parts of the front side envelope pressing part 26*a* of the envelope pressing member 26 is respectively inserted into the grooves 27*b* and 27*c* of the supporting plate 27, respectively.

The grooves 27*b* and 27*c* of the supporting plate 27 are formed with the same height. Namely, the envelope pressing member 26 is installed with the horizontal shape structure or without the step shape structure.

According to this embodiment having the modified envelope pressing member installation structure and the modified base member, similar effects to those shown in the former embodiment can be obtained.

Besides, in the electronic photography printing machine shown in FIG. 1, by exchanging the envelope feeding apparatus 12 with the paper feeding cassette having the general A4 size (the paper feeding apparatus), it is possible to record to the popular paper.

As the exchange-over of the envelope printing and the popular paper printing, not shown in figure, there are methods, for example, a method for operating a paper and/or an envelope selection switch provided on the main body of the electronic photography printing machine by replacing the paper feeding apparatus with the envelope feeding apparatus, and a method for automatically carrying out according to an output of the detection means for discriminating the cassette provided on the electronic photography printing machine and a method for manually changing over an exchange-over switch provided on the main body of the electronic photography printing machine.

As stated in above, according to the present invention the following effects can be obtained. That is, the failure in the feeding operation of the envelopes due to the non-uniformity of the stacked height at the flap portion and the anti-flap portion of the envelopes, the skew state of the envelope, the folding of the corner portion of the tip portion of the envelopes, and the jam phenomenon during the envelope feeding operation can be prevented.

Further, since the envelope pressing member is constituted by the elastic material, it is possible to easily follow the kinds of the envelopes and the fluctuations of the thickness in the envelopes etc., as a result a stable envelope feeding apparatus can be provided.

What is claimed is:

1. An envelope feeding apparatus for printing stacked envelopes in an electronic copying machine and an electronic photography printing machine etc. comprises:

a cassette for accommodating said stacked envelopes;

a base member for holding said stacked envelopes;

a pressurizing spring member for pressing under pressure said base member; and an envelope pressing member for pressing under pressure said stacked envelopes from an upper face of said stacked envelopes; wherein the envelope feeding apparatus further comprises, a door spring member for enabling to open and close both end portions of said envelope pressing member as fulcrums, said envelope pressing member giving a pressurized force against said stacked envelopes and being formed by a continuous rod shape elastic material, and a plate shape supporting member for supporting an intermediate portion of said envelope pressing member.

2. In an envelope feeding apparatus according to claim 1, wherein a tip end of said envelope pressing member is positioned at a tip end portion of said staked envelopes.

3. In an envelope feeding apparatus according to claim 1, wherein a height of a right tip portion of said envelope pressing member differs from a height of a left tip portion of said envelope pressing member.

4. In an envelope feeding apparatus according to claim 1, wherein said envelope pressing member is detachably inserted through said plate shape supporting member for supporting said intermediate portion of said envelope pressing member, and said envelope pressing member is reversely installed.

5. In an envelope feeding apparatus according to claim 1, wherein a central portion of said base member toward a right and left direction is formed higher than a height of a right side of said base member and a height of a left side of said base member, and the height of said right side of said base member differs from the height of said left side of said base member.

6. An electronic photography printing machine comprises:

a photosensitive body;

a charging means for uniformly charging said photosensitive body;

an exposing means for exposing said uniformly charged photosensitive body and for forming an electrostatic image;

a developing means for developing said electrostatic image by toners and for forming a toner image;

a transferring means for transferring said toner image to a recording medium; and a recording feeding apparatus for supplying said recording medium, wherein said recording medium feeding apparatus comprises a popular paper feeding apparatus and an envelope feeding apparatus, an appearance of a dimension of said envelope feeding apparatus is formed to have the same appearance of a dimension of said popular paper feeding apparatus, according to the exchange-over of said envelope feeding apparatus and by determining a kind of said recording medium, said toner image is printed to a desired recording medium, wherein said envelope feeding apparatus comprises:

a door spring member for enabling to open and close both end portions of an envelope pressing member as fulcrums, said envelope pressing member giving a pressurized force against stacked envelopes and being formed by a continuous rod shape elastic material, and a plate shape supporting member for supporting an intermediated portion of said envelope pressing member.

7. An electronic photography printing machine comprises:

a photosensitive body;

a charging means for uniformly charging said photosensitive body;

an exposing means for exposing said uniformly charged photosensitive body and for forming an electrostatic image;

a developing means for developing said electrostatic image by toners and for forming a toner image;

a transferring means for transferring said toner image to a recording medium; and a recording medium feeding apparatus for supplying said recording medium wherein said recording medium feeding apparatus comprises a popular paper feeding apparatus and an envelope feeding apparatus, an appearance of a dimension of said envelope feeding apparatus is formed to have the same appearance of a dimension of said popular paper feeding apparatus, according to the exchange-over of said envelope feeding apparatus and by discriminating a kind of said recording medium, said toner image is printed to a desired recording medium;

wherein the envelope feeding apparatus comprises, a cassette for accommodating stacked envelopes;

a base member for holding stacked envelopes;

a pressurizing spring member for pressing under pressure said base member;

an envelope pressing member for pressing said stacked envelopes from an upper face of said stacked envelopes;

a door spring member for enabling to open and close both end portions of said envelope pressing member as fulcrums, an envelope pressing member for giving a pressurized force against said stacked envelopes, said envelope pressing member being formed by a continuous rod shape elastic material, and a plate shape supporting member for supporting an intermediate portion of said envelope pressing member.

8. An envelope feeding apparatus for used in an electronic machine comprises:

a cassette for accommodating stacked envelopes;

a base member for holding said stacked envelopes;

a pressurizing spring member for pressing under pressure said base member; and an envelope pressing member for pressing under pressure said stacked envelopes from an upper face of said stacked envelopes; wherein the envelope paper feeding apparatus further comprises, at least one door spring member for enabling to open and close both end portions of said envelope pressing member as fulcrums, and said envelope pressing member being formed by a continuous rod shape elastic material.

9. An electronic photography printing machine comprises:

a photosensitive body;

a charging means for uniformly charging said photosensitive body;

an exposing means for exposing said uniformly charged photosensitive body and for forming an electrostatic image;

a developing means for developing said electrostatic image by toners and for forming a toner image;

a transfer means for transferring said toner image to a recording medium; and a feeding apparatus for supplying said recording medium wherein said recording medium feeding apparatus comprises a popular paper feeding apparatus and an envelope feeding apparatus, an appearance of a dimension of said envelope feeding apparatus is formed to have the same appearance of a dimension of said popular paper feeding apparatus, according to the exchange-over of said envelope feeding apparatus and by discriminating a kind of said recording medium, said toner image is printed to a desired recording medium and wherein the envelope feeding apparatus comprises a cassette for accommodating said stacked envelopes;

a base member for holding said stacked envelopes;

a pressurizing spring member for pressing under pressure said base member;

an envelope pressing member for pressing said stacked envelopes from an upper face of said stacked envelopes;

at least one door spring member for enabling to open and close both end portions of said envelope pressing member as fulcrums, and said envelope pressing member being formed by a continuous rod shape continuous elastic material.

* * * * *

UNITED STATES PATENT AND TRADEMARK OFFICE

CERTIFICATE OF CORRECTION

PATENT NO. : 5,640,664

DATED : 17 June 1997

INVENTOR(S) : Syoji UKEI et al.

It is certified that error appears in the above-identified patent and that said Letters Patent is hereby corrected as shown below:

| Column | Line | |
|---|---|---|
| 1 | 56 | After "Recently" insert --,--. |
| 1 | 57 | Change "is" to --were--; change "there, however" to --there. However,--; delete "there occurs". |
| 1 | 58 | After "operation" insert --occur--. |
| 1 | 59 | After "envelopes" insert --,--. |
| 3 | 9 | Change "an" to --a--. |
| 3 | 56 | Before "consideration" delete "the"; after "consideration" delete "under". |
| 3 | 65 | Change "unbalance" to --unbalanced--. |
| 5 | 60 | Change "for" to --as--. |
| 6 | 34 | Change "absorbent" to --absorption--. |
| 6 | 38 | After "feeding" insert --,--; change "unbalance" to --imbalance--. |

UNITED STATES PATENT AND TRADEMARK OFFICE

CERTIFICATE OF CORRECTION

PATENT NO. : 5,640,664

DATED : 17 June 1997

INVENTOR(S) : Syoji UKEI et al.

It is certified that error appears in the above-identified patent and that said Letters Patent is hereby corrected as shown below:

| Column | Line | |
|---|---|---|
| 6 | 51 | Change "unbalance" to --imbalance--. |
| 6 | 61 | After "envelopes" insert --which--. |
| 6 | 63 | Change "envelopes" to --envelope--. |
| 6 | 64 | Delete "in". |
| 6 | 65 | After "further" insert --the--. |
| 7 | 56 | Change "holden" to --held--. |
| 7 | 57 | Before "interior" insert --the--. |
| 8 | 24 | Change "holden" to --held--. |
| 8 | 27 | Change "accommodated" to --accumulated--. |
| 8 | 32 | Change "move" to --moves--. |
| 9 | 48 | Change "followings" to --follows--. |
| 9 | 67 | Change "turn" to --turned--. |

UNITED STATES PATENT AND TRADEMARK OFFICE

CERTIFICATE OF CORRECTION

PATENT NO. : 5,640,664

DATED : 17 June 1997

INVENTOR(S) : Syoji UKEI et al.

It is certified that error appears in the above-identified patent and that said Letters Patent is hereby corrected as shown below:

| Column | Line | |
|---|---|---|
| 11 | 20 | Delete "in"; after "invention" insert --,--. |
| 13 | 28 | Change "used" to --use--. |

Signed and Sealed this

Third Day of March, 1998

*Attest:*

Bruce Lehman

BRUCE LEHMAN

*Attesting Officer*

*Commissioner of Patents and Trademarks*